US007624688B2

(12) United States Patent
Kulbeth et al.

(10) Patent No.: US 7,624,688 B2
(45) **Date of Patent: *Dec. 1, 2009**

(54) PALLET ASSEMBLY

(75) Inventors: Jimmy D. Kulbeth, Santa Claus, IN (US); Raymond C. Niehaus, Santa Claus, IN (US); James Neil Davis, Charlestown, IN (US)

(73) Assignee: Universal Package System, L.L.C., Dale, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/464,603

(22) Filed: Aug. 15, 2006

(65) Prior Publication Data

US 2006/0288915 A1 Dec. 28, 2006

Related U.S. Application Data

(62) Division of application No. 10/460,868, filed on Jun. 13, 2003, now Pat. No. 7,111,561.

(51) Int. Cl.
*B65D 19/00* (2006.01)

(52) U.S. Cl. ..... 108/51.11; 206/386

(58) Field of Classification Search ..... 108/55.1, 108/56.1, 51.11; 206/386, 600; 229/125.17, 229/104; 220/1.5, 4.29, 345.3, 787, 788, 220/73, 74, 47, 6, 7, 324, 675
See application file for complete search history.

(56) References Cited

U.S. PATENT DOCUMENTS

| | | | | | |
|---|---|---|---|---|---|
| 3,828,964 | A * | 8/1974 | Bonnot | 220/1.5 |
| 4,765,252 | A * | 8/1988 | Shuert | 108/55.1 |
| 4,967,927 | A * | 11/1990 | Reiland et al. | 220/817 |
| 4,989,731 | A * | 2/1991 | Shuert | 108/55.1 |
| 5,029,734 | A * | 7/1991 | Nichols | 108/55.3 |
| 5,109,985 | A * | 5/1992 | Rose | 108/55.1 |
| 5,133,460 | A * | 7/1992 | Shuert | 108/55.1 |
| 5,722,328 | A * | 3/1998 | Darby | 108/55.1 |
| RE35,875 | E * | 8/1998 | Shuert | 108/55.1 |
| 5,829,595 | A * | 11/1998 | Brown et al. | 206/600 |
| 6,024,223 | A * | 2/2000 | Ritter | 206/600 |
| 7,090,078 | B2 * | 8/2006 | Gits | 206/386 |
| 7,111,561 | B2 * | 9/2006 | Kulbeth et al. | 108/51.11 |

* cited by examiner

*Primary Examiner*—José V Chen
(74) *Attorney, Agent, or Firm*—Greenebaum Doll & McDonald PLLC; Glenn D. Bellamy

(57) ABSTRACT

Shown is a pallet assembly having a lid and a pallet, either or both of which can include one or more cam lock assemblies. A sleeve can be placed between the lid and pallet with the lid and pallet cam lock assemblies engaging the sleeve to secure the pallet for shipping things. Alternatively, the sleeve can be folded and placed between the lid and pallet with the lid cam lock assemblies engaging the pallet to secure the pallet assembly for empty return and later reuse.

2 Claims, 18 Drawing Sheets

PALLET ASSEMBLY

RELATED APPLICATION

This application is a divisional of application Ser. No. 10/460,868, filed Jun. 13, 2003, now U.S. Pat. No. 7,111,561, issued Sep. 26, 2006.

BACKGROUND OF THE INVENTION (a) Field of the Invention

The present invention relates to a pallet assembly having a lid and a pallet, either or both of which can include one or more cam lock assemblies. A sleeve can be placed between the lid and pallet with the lid and pallet cam lock assemblies engaging the sleeve to secure the pallet for shipping things. Alternatively, the sleeve can be folded or collapsed and placed between the lid and pallet with the lid cam lock assemblies engaging the pallet to secure the pallet assembly for empty return and later reuse.

(b) Description of the Prior Art

U.S. Pat. No. 5,529,199, to Foster, issued Jun. 25, 1996; U.S. Pat. No. 3,374,915, to Verhein et al., issued Mar. 26, 1968; and U.S. Pat. No. 3,266,656, to Kridle, issued Aug. 16, 1966 teach various multiple component or collapsible pallet systems. None of the references located teach a top piece or lid which has a lip which abuts a pallet wall lip to provide both a more stable engagement and a relatively contamination free interior. Also, none of the references located teach the cam lock assemblies employed with the present invention.

SUMMARY OF THE INVENTION

The present invention relates to a pallet assembly having a lid and a pallet, either or both of which can include one or more cam lock assemblies. A sleeve can be placed between the lid and pallet with the lid and pallet cam lock assemblies engaging the sleeve to secure the pallet for shipping things. Alternatively, the sleeve can be folded or collapsed and placed between the lid and pallet with the lid cam lock assemblies engaging the pallet to secure the pallet assembly for empty return and later reuse.

The pallet assembly of the present invention may simply comprise a lid and a pallet, the lid having a top portion and sides therearound, the sides therearound having an inverted channel therein which has a channel lip, the lid having a lid outside and a lid inside; the pallet having a pallet outside, a pallet inside, a pallet base portion, and a wall portion extending upward therefrom, the wall portion having an outer wall portion and an inner wall portion, the wall portion terminating in a pallet lip portion. The lid can be placed onto the pallet and supported thereon by an engagement of the channel lip and the pallet lip portion. In this configuration with the lips in engagement, the lid inside and pallet inside form a virtually contamination free interior volume. Cam lock assemblies and a sleeve, as explained hereinafter, can be incorporated with this pallet assembly.

More particularly, the cam lock assembly of the present invention comprises a cylindrical cam; a handle; a spacer positioned between the handle and the cylindrical cam, the spacer engaging the cylindrical cam and the handle; and a lock having a cam engaging portion, a hook portion, and a connecting portion between the cam engaging portion and the hook portion, the cam engaging portion engaging the cam. The cylindrical cam can have opposed tapered ends and the handle and spacer can be of unitary or non-unitary construction. The handle, spacer, cylindrical cam, and cam engaging portion of the lock have at least one opening therethrough which has a threaded bolt inserted therethrough with a nut thereon. To be used with a pallet assembly in a lid, the handle includes a cam engaging portion and an adjacent angled handle portion, the adjacent angled handle portion being angled from the cam engaging portion in a direction toward the cylindrical cam. To be used with a pallet assembly in a pallet, the handle includes a cam engaging portion and an adjacent angled handle portion, the adjacent angled handle portion being angled from the cam engaging portion in a direction away from the cylindrical cam. Either handle can have a head on an end opposite the cam engaging portion.

More particularly, the pallet assembly of the present invention can employ one or more of the above described cam lock assemblies. The pallet assembly comprises a lid and a pallet, the lid having a lid outside and a lid inside and the pallet having a pallet outside and a pallet inside; the lid has at least one lid cam lock assembly housed by a cam lock assembly housing; the at least one lid cam lock assembly has a cylindrical cam within the cam lock assembly housing, a handle accessible from the lid outside, a spacer positioned between the handle and the cylindrical cam, and a lock having a cam engaging portion, a hook portion, and a connecting portion between the cam engaging portion and the hook portion, the cam engaging portion engaging the cam, the lock being located on the lid inside; the pallet has a pallet base portion and a wall portion extending upward therefrom, the wall portion has an outer wall portion and an inner wall portion and terminates in a lip portion; the inner wall portion has at least one lid cam lock receiving receptacle therein; where, the lid can be placed onto the pallet and supported thereon by the lip portion and the handle of the at least one lid cam lock assembly can be moved from an open position to a closed position, thereby having the hook portion of the lock of the at least one cam lock assembly engage the at least one lid cam lock receiving receptacle. This pallet assembly can further comprise a sleeve having at least one lid cam lock receiving opening therein and at least one pallet cam lock receiving opening therein; where the pallet has at least one pallet cam lock assembly housed by a cam lock assembly housing; the at least one pallet cam lock assembly has a cylindrical cam within the cam lock assembly housing, a handle accessible from the pallet outside, a spacer positioned between the handle and the cylindrical cam, and a lock having a cam engaging portion, a hook portion, and a connecting portion between the cam engaging portion and the hook portion, the cam engaging portion engaging the cam, the lock located on the pallet inside; where the sleeve can be placed into the pallet and extend upward therefrom, thereby engaging the pallet base portion and being adjacent the inner wall portion, the handle of the at least one pallet cam lock assembly can be moved from an open position to a closed position, thereby having the hook portion of the lock of the at least one pallet cam lock assembly engage the at least one pallet cam lock receiving opening in the sleeve; where the lid can be placed onto the sleeve and supported thereon, the handle of the at least one lid cam lock assembly can be moved from an open position to a closed position, thereby having the hook portion of the lock of the at least one lid cam lock assembly engage the at least one lid cam lock receiving opening in the sleeve.

If cam lock assemblies are to be employed with the pallet assembly, it is noted that one lid cam lock assembly and corresponding receptacle could be employed. Also, two cam lock assemblies and corresponding receptacles could be employed, for example, the two cam lock assemblies could be located diagonally across the lid. Other cam lock assembly quantities and locations are possibly. The same applies to the pallet cam lock assemblies and to the various sleeve lock receiving openings. However, most preferably, to create a more securable pallet assembly, the at least one lid cam lock assembly comprises four lid cam lock assemblies and the at least one lid cam lock receiving receptacle comprises four corresponding lid cam lock receiving receptacles and the at least one lid cam lock receiving opening in the sleeve comprises four corresponding lid cam lock receiving openings in the sleeve; and the at least one pallet cam lock assembly comprises four pallet cam lock assemblies and the at least one pallet cam lock receiving opening in the sleeve comprises four corresponding pallet cam lock receiving openings in the sleeve. Here, the lid has four sides, two of the four lid cam lock assemblies are located toward opposed ends of a first of the four sides and the other two of the four lid cam lock assemblies are located toward opposed ends of a second of the four sides, the second side and the first side being opposed sides; and, the pallet has four sides, two of the four pallet cam lock assemblies are located toward opposed ends of a first of the four sides and the other two of the four pallet cam lock assemblies are located toward opposed ends of a second of the four sides, the second side and the first side being opposed sides. Also, it is preferable that the sleeve can be folded and placed within the pallet inside, the sleeve has four walls having routed fold areas therebetween, a first wall and an opposed second wall of the four walls each having a fold seam therein.

More particularly, the preferred sleeve of the present invention for use with this or other pallet assemblies comprises a piece of material, preferably a corrugated polypropylene plastic material, the piece of material having an outer skin, an inner skin, and corrugations or verticals therebetween, the piece having a top and a bottom and four sides. Between each of the adjacent sides, there is a routed fold area which extends from the top to the bottom where the routing removes all of the piece except for the outer skin. Also, on two opposed sides, there is a fold seam routed from the top to the bottom along a side center line where the routing removes all of the piece except the outer skin. If the sleeve has two opposed long sides and two opposed short sides, the fold seams are in the two opposed short sides. The fold seams permit the short sides to fold inward and the routed fold areas between the four adjacent sides permit the sleeve to collapse flat. The sleeve can be assembled from one or multiple pieces of material and, when assembled as the sleeve, is referred to above as a piece of material. For this assembly the appropriate ends of the one or more pieces of material will be preferably butt welded to each other.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

With reference to FIGS. 1-27, the pallet assembly 10 of the instant invention is shown. The following is a cross-reference to numerals used in the figures: 10—pallet assembly; 12—sleeve; 13—sleeve short side walls; 14—fold seam; 15—sleeve long walls; 16—weld seam; 17—routed fold area; 18—lid cam lock receiving bores; 19—pallet cam lock receiving bores; 20—lid; 22—molded top portion; 23—ribs; 24—cavities; 25—stacking posts; 26—side inner wall; 27—side outer wall; 28—lip; 29—inverted channel; 30—cam lock assembly molded housing; 32—cylindrical portion; 34—tapered ends; 36—openings; 40—lid cam lock assembly; 41, 141—cam; 42, 142—cylindrical portion; 43—tapered ends; 44, 144—countersunk portion; 45—bore; 46, 146—lid handle; 47, 147—cam engaging portion; 48, 148—spacer; 49—bore; 50—angled handle portion; 51—head; 52—lock; 53—arched cam engaging portion; 54, bore; 55—connecting portion; 56—hook portion; 57—straight portion; 58—curved end portion; 59—bolt; 60—head; 61—threaded portion; 62—lock nut; 70—pallet; 71—base portion; 72—cavitied base portion; 73—inner wall portion; 74—outer wall portion; 75—top wall lip portion; 76—pallet cam lock recess; 77—lid cam lock receptacle; 78—skid; 79—cam lock assembly molded housing; 80—pallet cam lock assembly; 86, 186—pallet handle; 87, 187—cam engaging portion; 88, 188—spacer; 89—bore; 90—angled handle portion; and 91—head.

Figure 1:
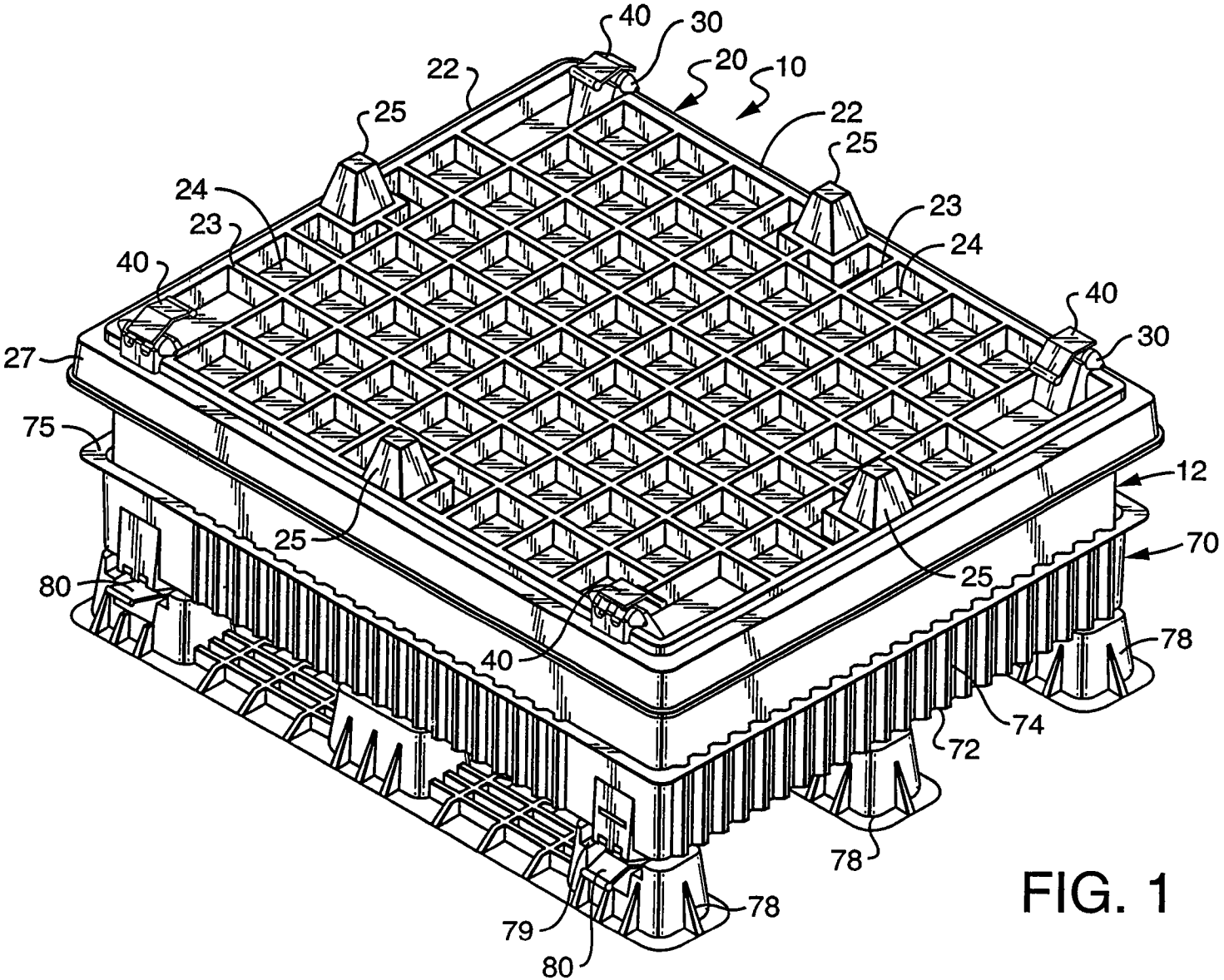
FIG. 1 shows a perspective view of the preferred pallet assembly.
Figure 2:
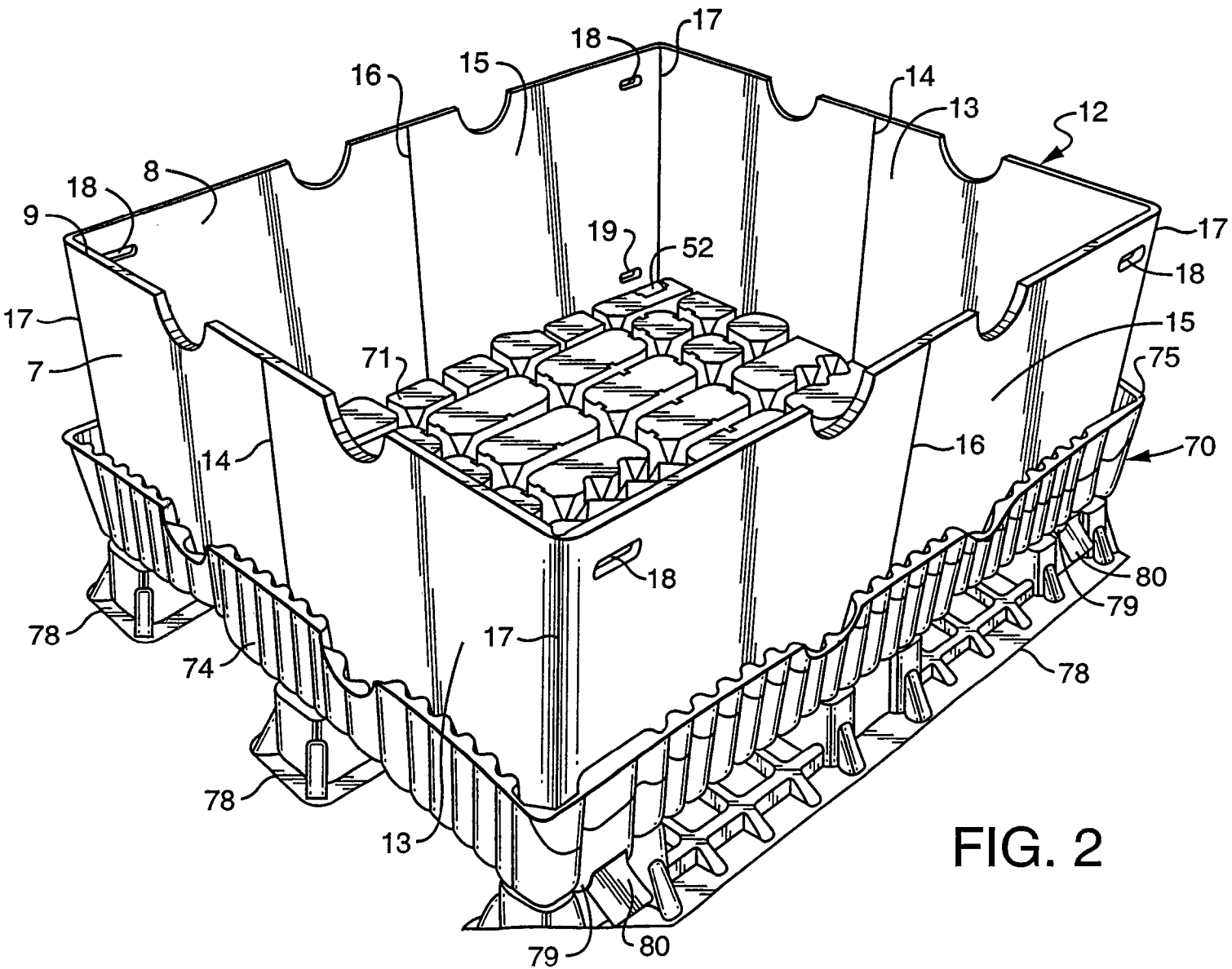
FIG. 2 shows a perspective view of a pallet with sleeve inserted therein.

FIG. 1 shows the pallet assembly 10 of the present invention. Also, as schematically shown in FIGS. 24-27, the pallet assembly 10 provides a lid 20 which includes four cam lock assembly molded housings 30 each housing a lid cam lock assembly 40. The assembly 10 also includes a sleeve 12 with lid cam lock receiving openings 18 toward the top of long walls 15 and pallet cam lock receiving openings 19 toward the bottom of long walls 15, each opening 19 being vertically below an opening 18 when the sleeve 12 is placed inside a pallet 70, as seen in FIG. 2. Further, assembly 10 includes a pallet 70, which includes four cam lock assembly molded housings 79 each housing a pallet cam lock assembly 80.

Figure 4:
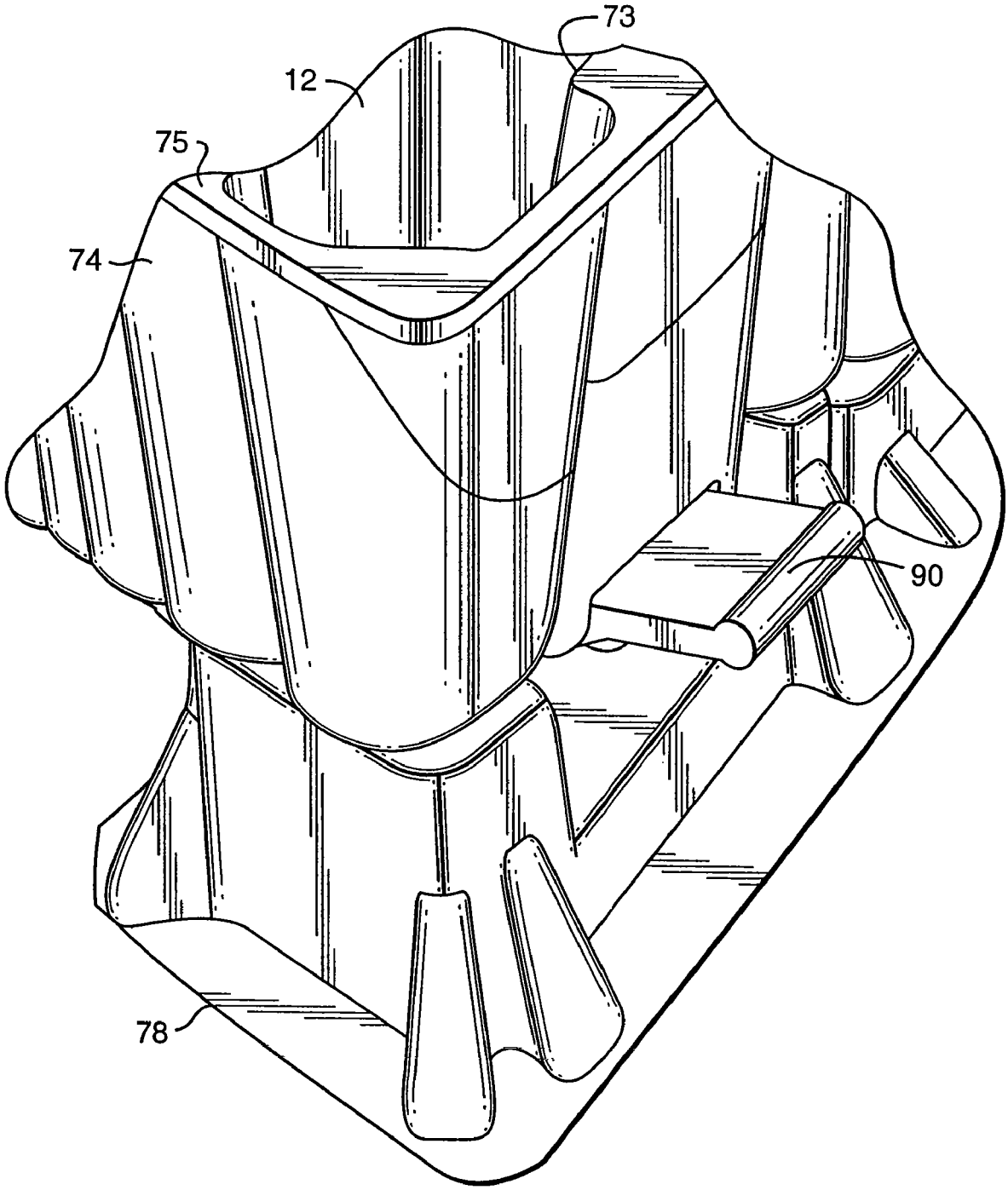
FIG. 4 is an enlarged view of a portion of a pallet, having a sleeve therein, showing one of the cam lock assembly molded housings with a pallet cam lock assembly therein, the cam lock assembly in the unlocked position.
Figure 5:
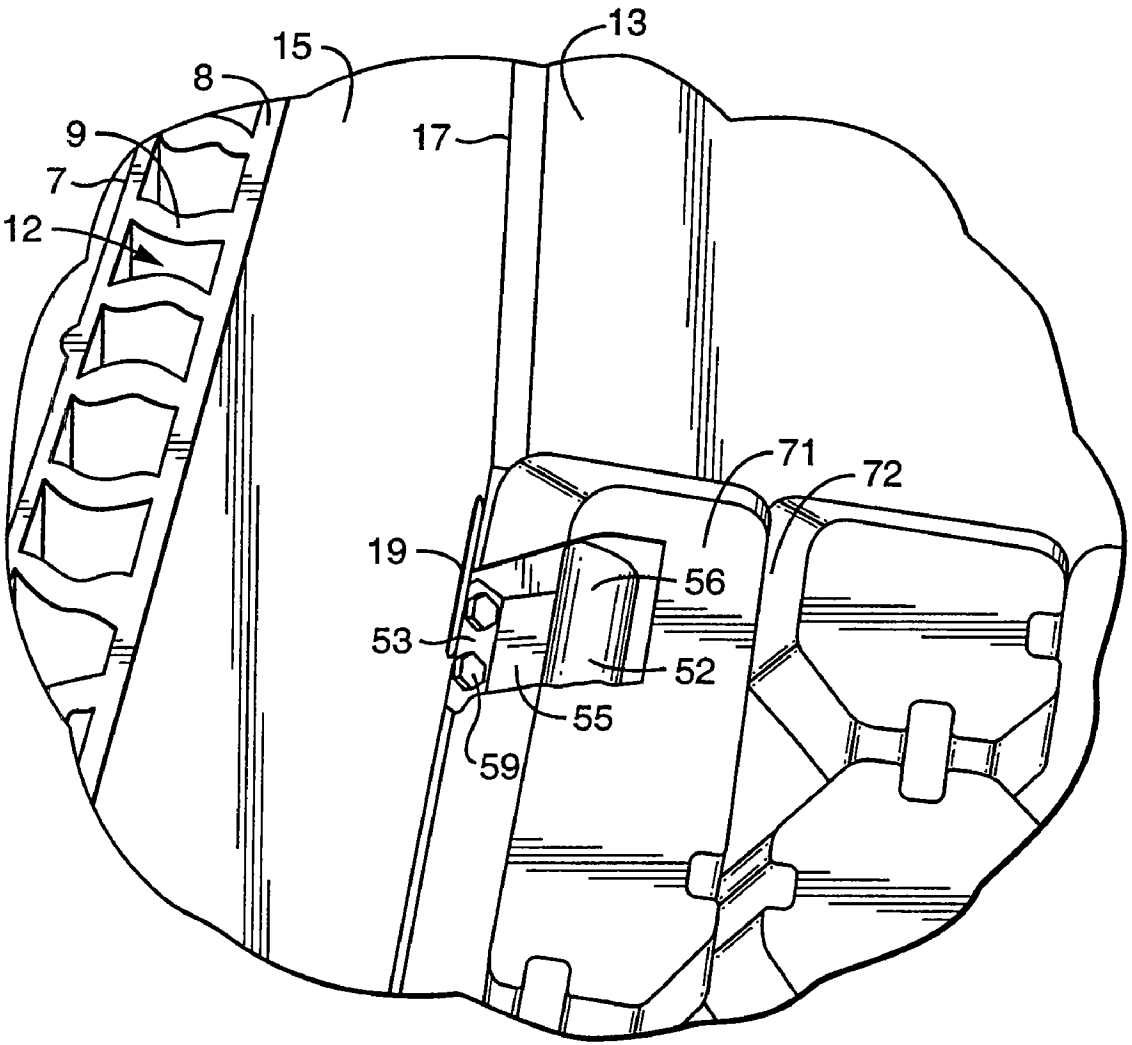
FIG. 5 is an enlarged interior view of the pallet, having a sleeve therein, showing the lock portion of the pallet cam lock assembly of FIG. 4 in the unlocked position.
Figure 6:
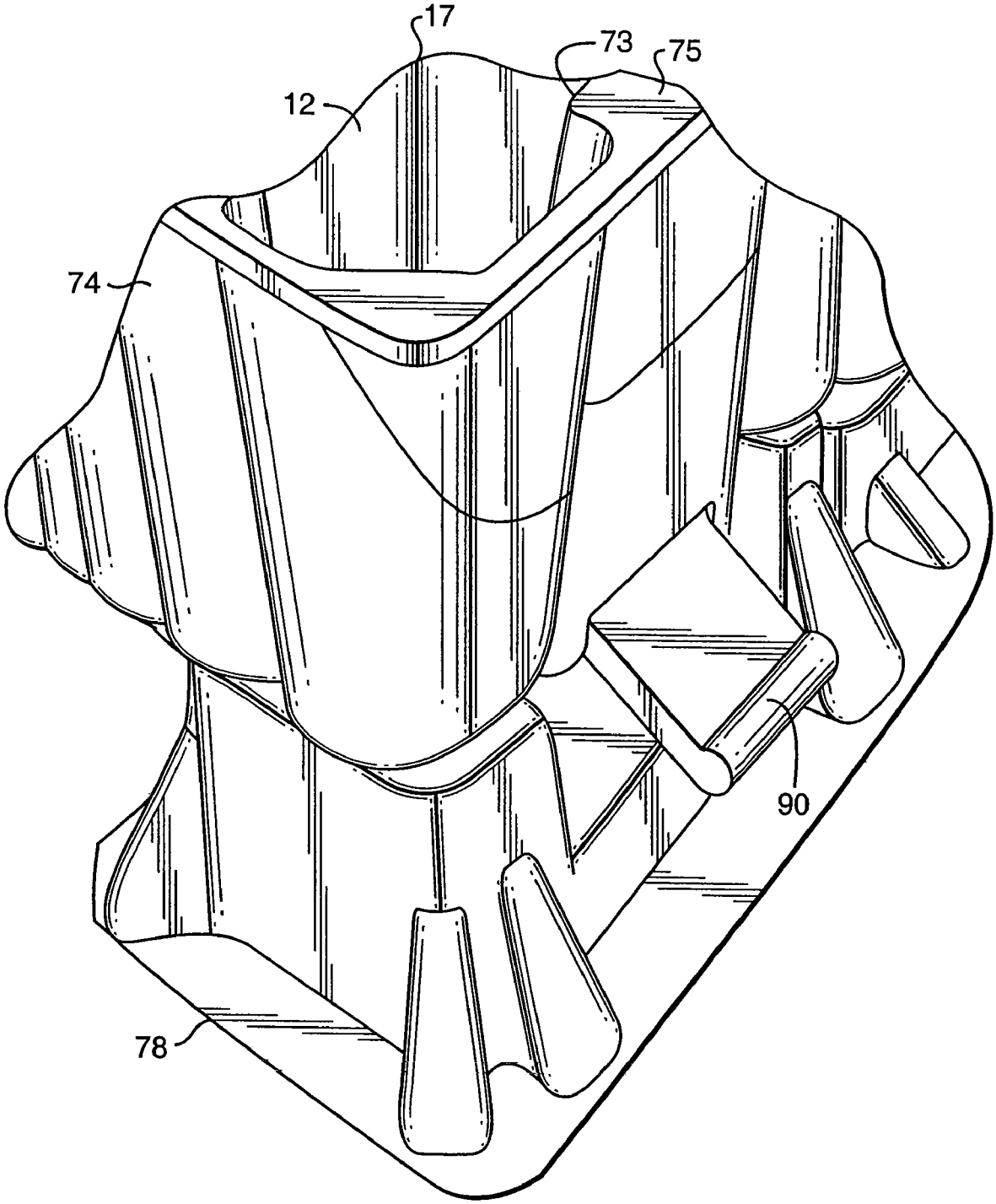
FIG. 6 is an enlarged view of a portion of a pallet, having a sleeve therein, showing one of the cam lock assembly molded housings with a pallet cam lock assembly therein, the cam lock assembly in the locked position.
Figure 7:
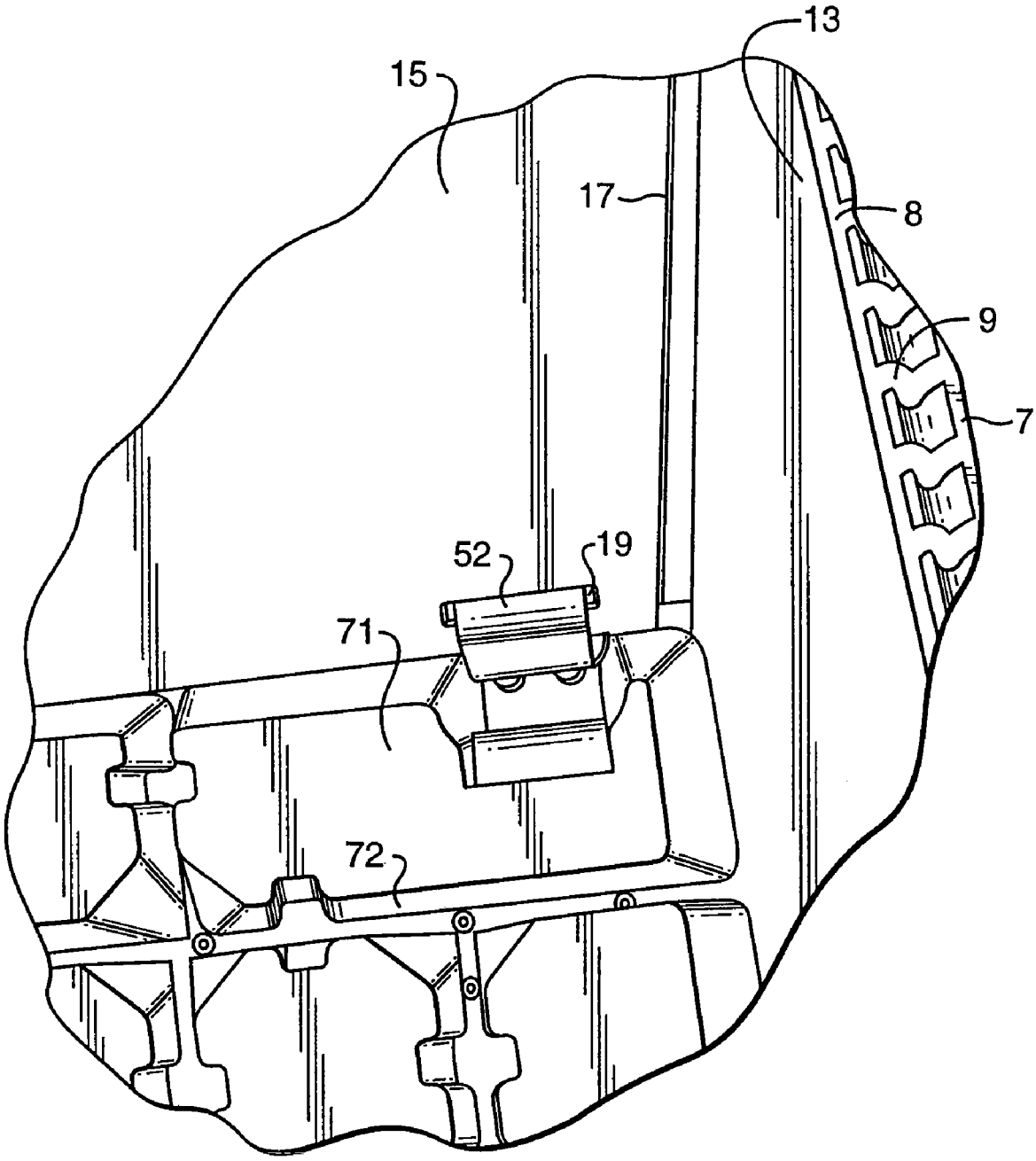
FIG. 7 is an enlarged interior view of the pallet, having a sleeve therein, showing the lock portion of the pallet cam lock assembly of FIG. 6 in the locked position.
Figure 8:
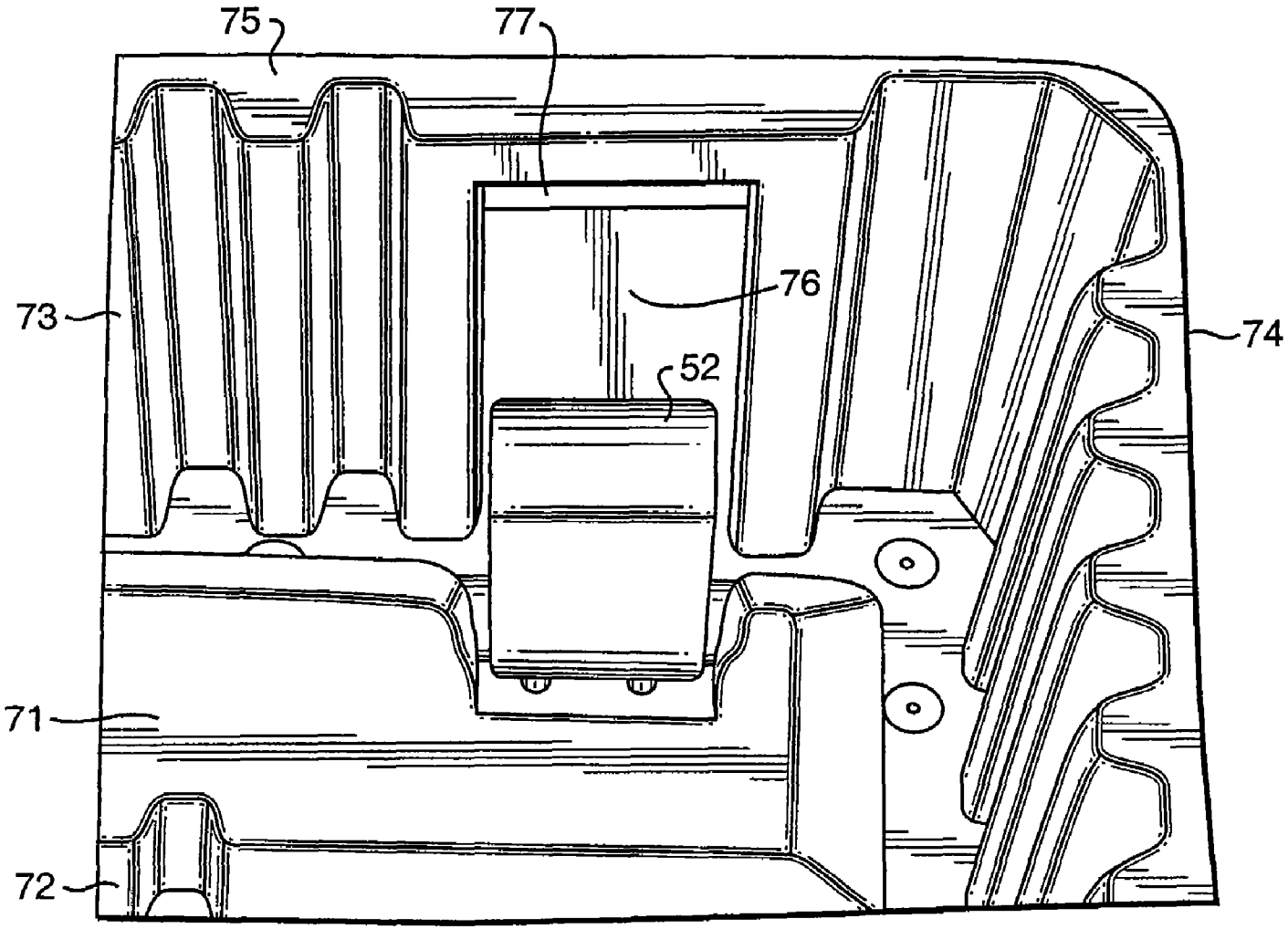
FIG. 8 is an interior view of the pallet with the sleeve removed, showing the recess for the pallet cam lock and the receptacle for the lid cam lock, the cam lock assembly in the locked position.
Figure 24:
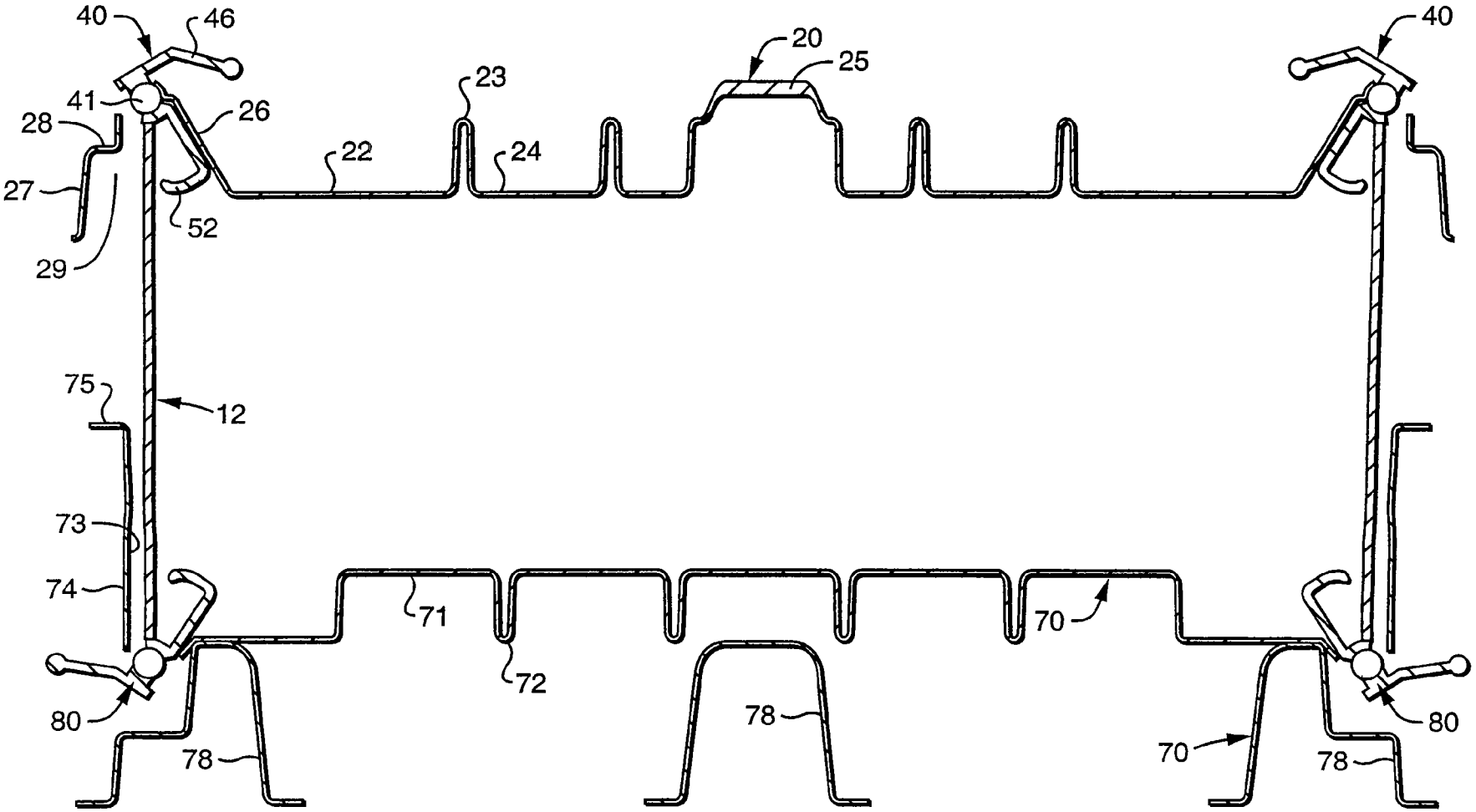
FIG. 24 is a schematic cross-section representation of a pallet assembly showing the lid and pallet with a sleeve and the lid and pallet cam lock assemblies in the unlocked positions.
Figure 25:
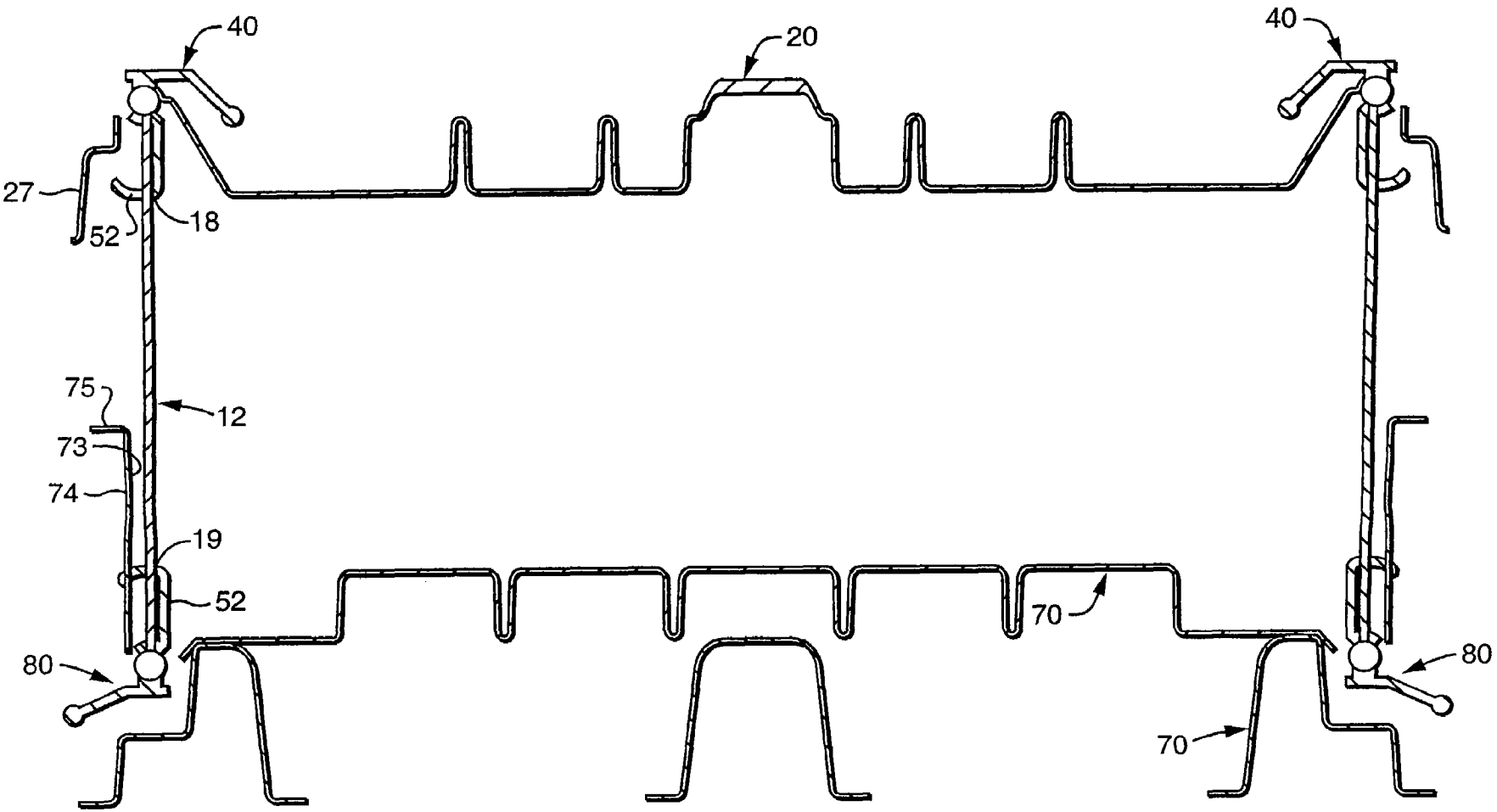
FIG. 25 is a schematic cross-section representation of a pallet assembly showing the lid and pallet with a sleeve and the lid and pallet cam lock assemblies in the locked positions.

When the pallet assembly 10 is to be used to ship things, the configuration of FIGS. 1 and 24-25 is used where the sleeve 12 is received between the pallet 70 and the lid 20, with the pallet 70 and sleeve 12 locked together by the lock 52 of each pallet cam lock assembly 80 being inserted into a corresponding pallet cam lock receiving opening 19 by a person pushing down on the head 91 or angled handle portion 90 of pallet handle 86. Sleeve 12 fits inside the outer wall portion 74 of pallet 70 adjacent inner wall portion 73 and the bottom of sleeve 12 engages the base portion 71 of pallet 70. Also, FIGS. 4 and 5 show the angled handle portion 90 and lock 52 in the unlocked position, lock 52 not engaging an opening 19 and handle portion 90 in its raised position, while FIGS. 6 and 7 show the angled handle portion 90 and lock 52 in the locked portion, lock 52 engaging an opening 19 and handle portion 90 in its lowered position. FIG. 8 shows that inner wall portion 73 includes a pallet cam lock receiving recess 77 which permits handle portion 90 to be placed in the locked position of FIGS. 6 and 7 and the corresponding lock 52 being received in recess 77 but not engaging the pallet 70.

With the sleeve 12 and pallet 70 locked together, things can be placed inside for shipment. Once the things have been placed inside, the lid 20 is placed atop sleeve 12. Side inner wall 26 and side outer wall 27 of lid 20 form an inverted channel 29 therebetween. It is this inverted channel 29 which receives the top of sleeve 12. Lid 20 and sleeve 12 are locked together by the lock 52 of each lid cam lock assembly 40 being inserted into a corresponding lid cam lock receiving opening 18 in sleeve 12 by a person pushing down on the head 51 or angled handle portion 50 of lid handle 46. With the lid and pallet cam lock assemblies 40/80 locked into respective lid and pallet cam lock receiving openings 18, 19 of sleeve 12, the pallet assembly 10 is secured and ready for shipment. The placement of the sleeve 12 within outer wall portion 74 of pallet 70 adjacent inner wall portion 73 and into inverted channel 29 of lid 20, along with the geometry of the lid cam lock assembly housing 30 and its lid cam lock assembly 40 and pallet cam lock assembly housing 79 and its pallet cam lock assembly 80 make the inside of the pallet assembly 10 virtually contamination free so that the things shipped therein do not become contaminated by outside elements during shipment.

Pallet assembly 10 has an advantage that the geometry of the lid 20 and the pallet 70 are such that the sleeve 12 can be removed, folded, and placed inside the pallet 70; the lid 20 can engage the pallet 70, and the lid cam lock assemblies 40 can lock the lid 20 to the pallet 70. This is accomplished by having the lock 52 of each lid cam lock assembly 40 engage a corresponding lid cam lock receiving receptacle 77 in inner wall portion 73, for example, as shown in FIG. 8. Receptacle 77 is preferably into inner wall portion 73 without extending through to outer wall portion 74. This permits the pallet assembly 10 to be shipped as a secured unit, again virtually contamination free. Therefore, the pallet assembly 10 can be reused with no or minimal maintenance.

Figure 26:
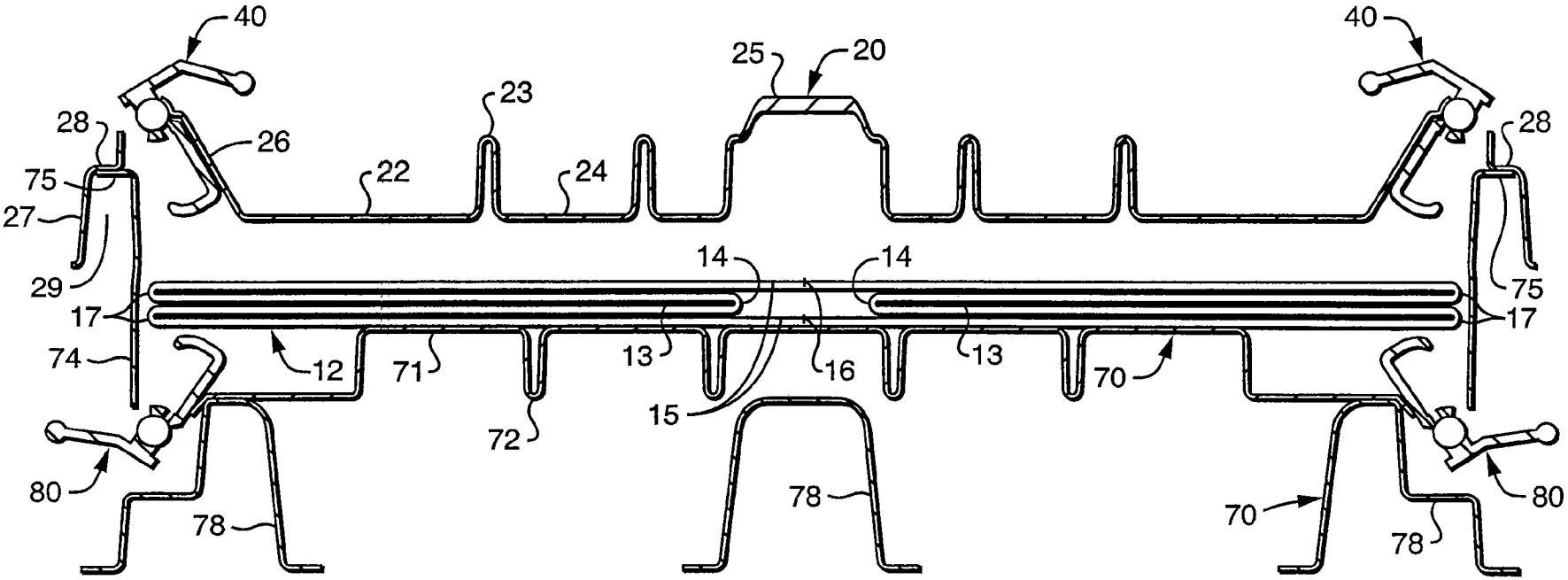
FIG. 26 is a schematic cross-section representation of a pallet assembly showing the lid and pallet having a folded sleeve in the pallet with the lid and pallet cam lock assemblies shown in the unlocked positions; and, FIG. 27 is a schematic cross-section representation of a pallet assembly showing the lid and pallet with the lid and pallet cam lock assemblies shown in the locked positions.
Figure 27:
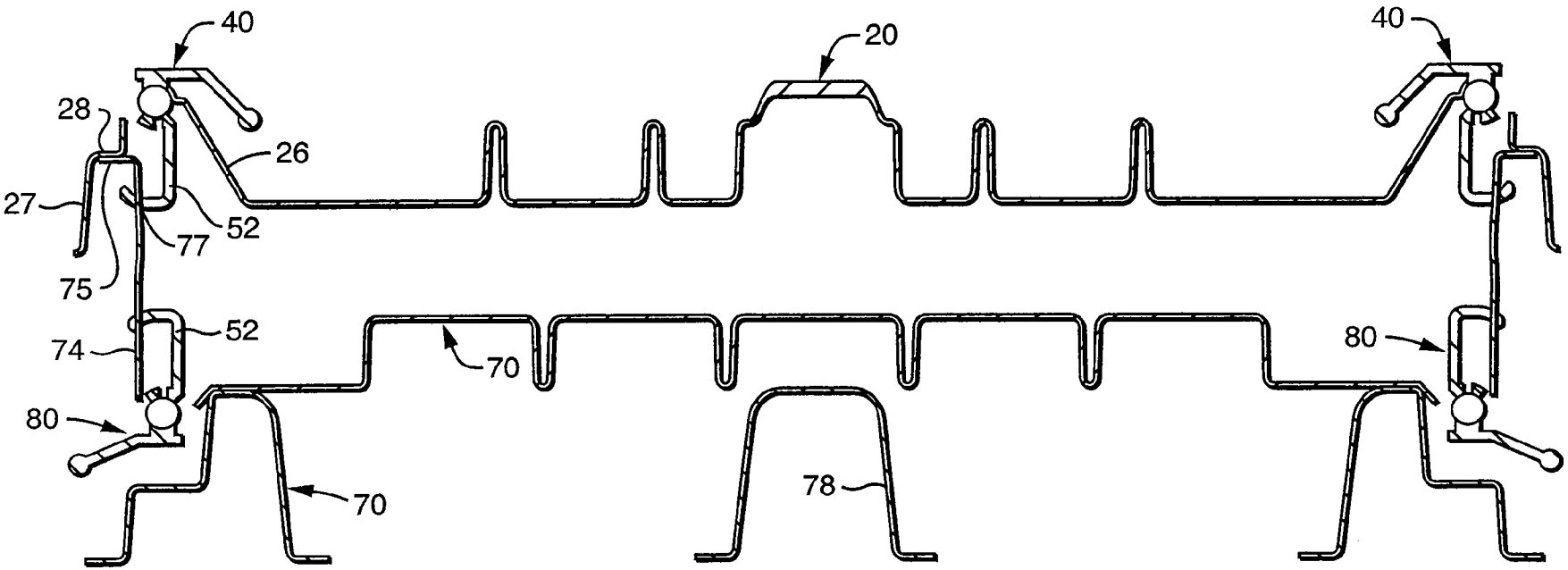

This is schematically demonstrated in FIGS. 26 and 27. Note that FIG. 26 shows how sleeve 12 can be collapsed and placed inside pallet 70. Sleeve 12 has its short side walls 13 folded inward at fold seam 14 so that the folded short side walls 13 lay between the long walls 15. This collapsing of sleeve 12 is permitted by fold seams 14 and routed fold areas 17.

The side outer wall 27 of lid 20 has a lip 28 thereround. Outer wall portion 74 of pallet 70 has a corresponding top wall lip portion 75 thereround. When lid 20 is placed atop pallet 70, outer wall portion 74 is partway received into inverted channel 29, such that top wall lip portion 75 abuts lip 28. In this position, the angled handle portion 50 or head 51 of each lid cam lock assembly 40 can be pushed down to lock the lock 52 of each assembly 40 into a corresponding lid cam lock receiving receptacle 77 (see FIG. 8) toward the top of inner wall portion 73. The angled handle portion 90 or head 91 of each pallet cam lock assembly 80 can remain in the open or locked position, as assembly 80 is not involved in securing the lid 20 and pallet 70. If pushed down, lock 52 of each assembly 80 simply rests in corresponding pallet cam lock receiving recess 76 toward the bottom of inner wall portion 73. With the pallet 70 in a horizontal position, corresponding recess 76 and receptacle 77 are in vertical alignment. In FIG. 26, the lid and pallet cam lock assemblies 40/80 are shown unlocked, while in FIG. 27, they are shown locked.

Figure 18:
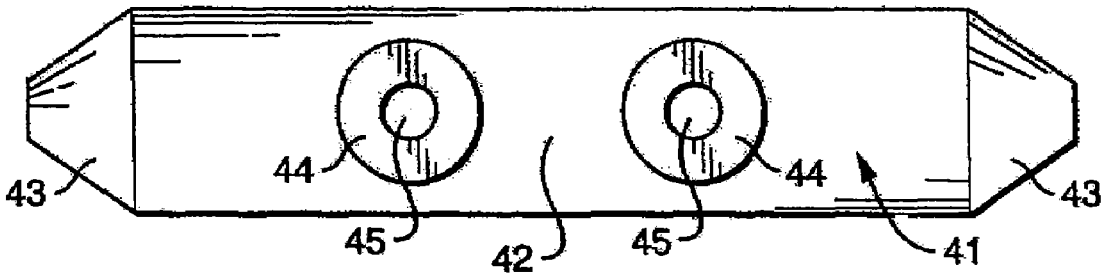
FIG. 18 is a top view of a preferred cam.
Figure 19:
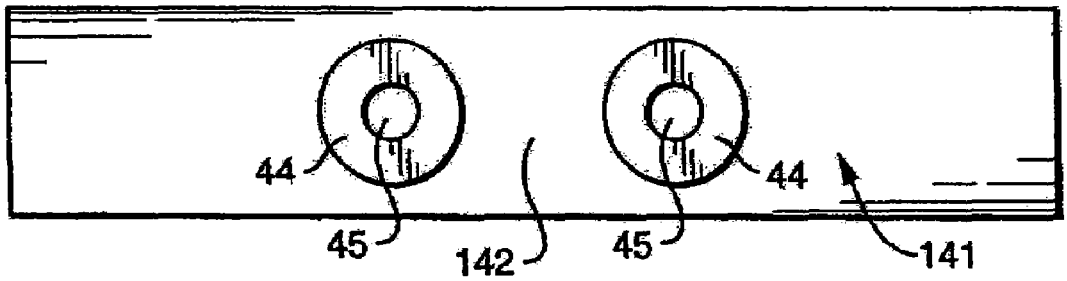
FIG. 19 is a top view of an alternative cam.

A preferred cam 41 is shown in FIG. 18 and an alternative cam 141 is shown in FIG. 19. Cams 41/141 are used in each lid cam lock assembly 40 and each pallet cam lock assembly 80. Both cams 41/141 have cylindrical portions 42/142. However, at each end of cam 41, there are tapered ends 43. Both cams 41/141 have bores 45 therethrough to receive some of the threaded portion 61 of a bolt 59. Because of cylindrical portions 42/142, around each bore 45 is a countersunk portion 44 so that, depending on the location of cam 41/141 and the handles (46, 146, 86, 186) used, a spacer 48 as a unitary part of the cam engaging portion 47 of lid handle 46, or a spacer 148 as a separate part of the cam engaging portion 147 of lid handle 146, or a spacer 88 as a unitary part of the cam engaging portion 87 of pallet handle 86, or a spacer 188 as a separate part of the cam engaging portion 187 of pallet handle 186, can more securely engage the cam cylindrical portion 42/142 than if the countersunk portion 44 was not there. As an alternative to placing a countersunk portion 44 in cam 41/141, spacers 48/148/88/188 can be made with a curved surface to match the surface of the cam 41 cylindrical portions 42/142.

The cam 41/141 is a solid rod of preferably ultra high molecular weight polyethylene (UHMW). However, other materials dissimilar to HDPE can be employed. For example, a polycarbonate resin sheet such as the trademarked "LEXAN" material of General Electric could be used. For cam 41, the desired dimensions are total length of 4.5 inches, diameter at cylindrical portion 42 of 0.875 inch, with taper from 0.875 inch diameter to 0.25 inch diameter over each 0.5 inch long tapered end portion 43. Bore 45 is 0.25 inch diameter and countersunk portion 44 is 0.625 inch diameter.

Desired cams 41/141 are placed in the mold where the lid 20 or pallet 70 is to be molded of HDPE, or high density polyethylene. As the HDPE and UHMW are not compatible, they will not form together in the molding process. This permits the cam 41/141 to be molded inside the desired cam or pallet lock assembly molded housing 30/79 of generally corresponding shape, as is explained hereinafter.

Figure 10:
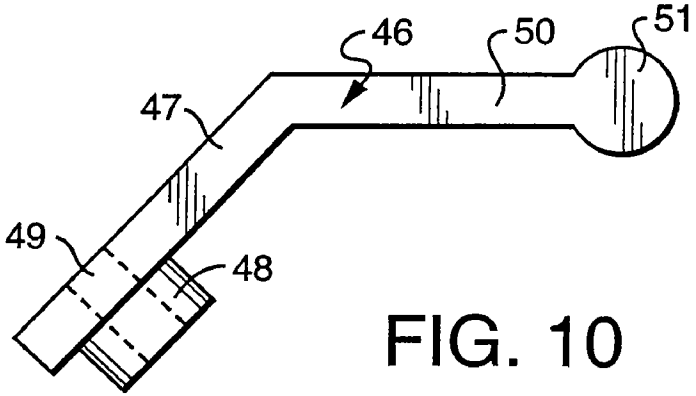
FIG. 10 is a side view of the lid handle of FIG. 9.
Figure 11:
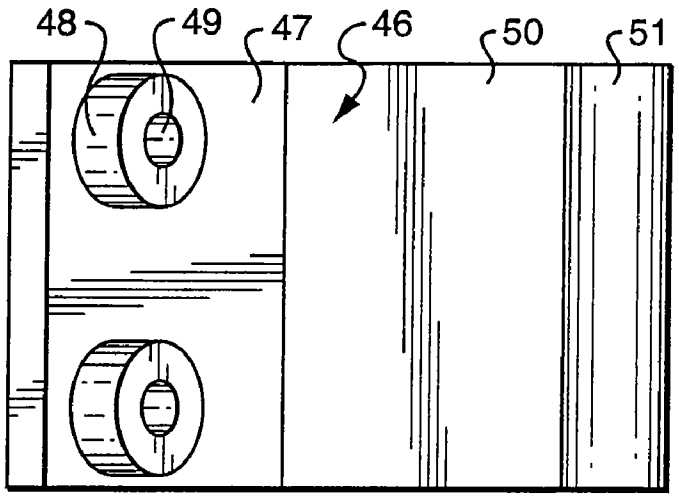
FIG. 11 is a bottom view of the lid handle of FIG. 9.
Figure 9:
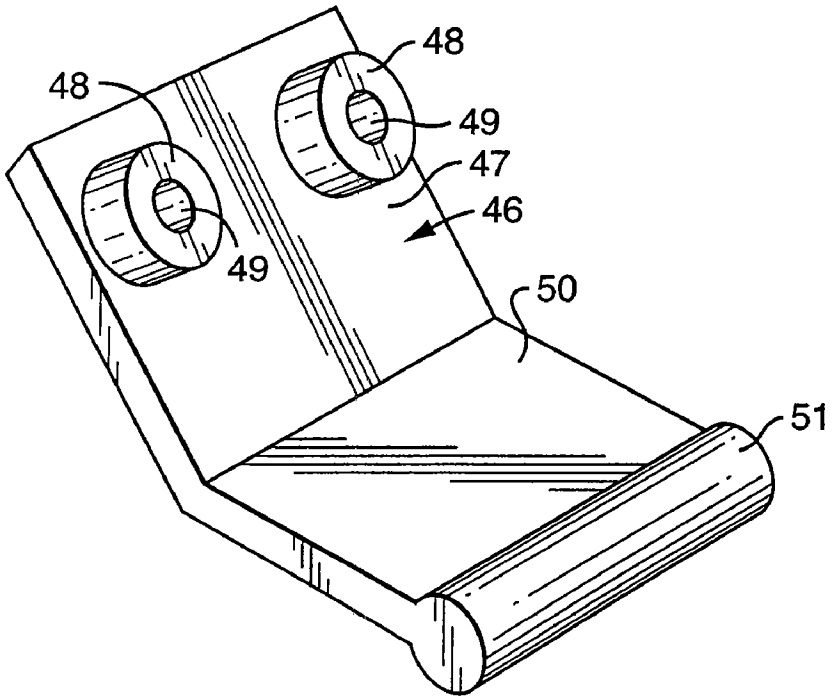
FIG. 9 is a perspective view of a lid handle.
Figure 20:
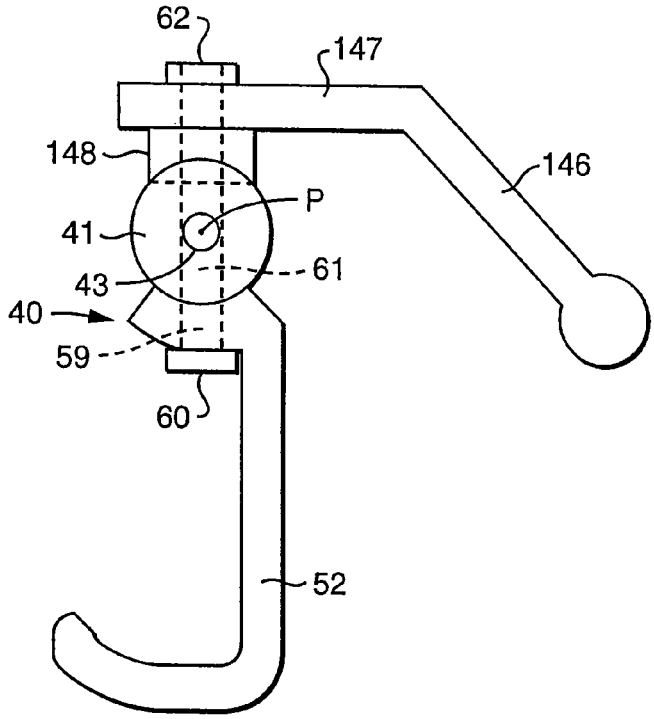
FIG. 20 represents a lid cam lock assembly in the locked position.
Figure 22:
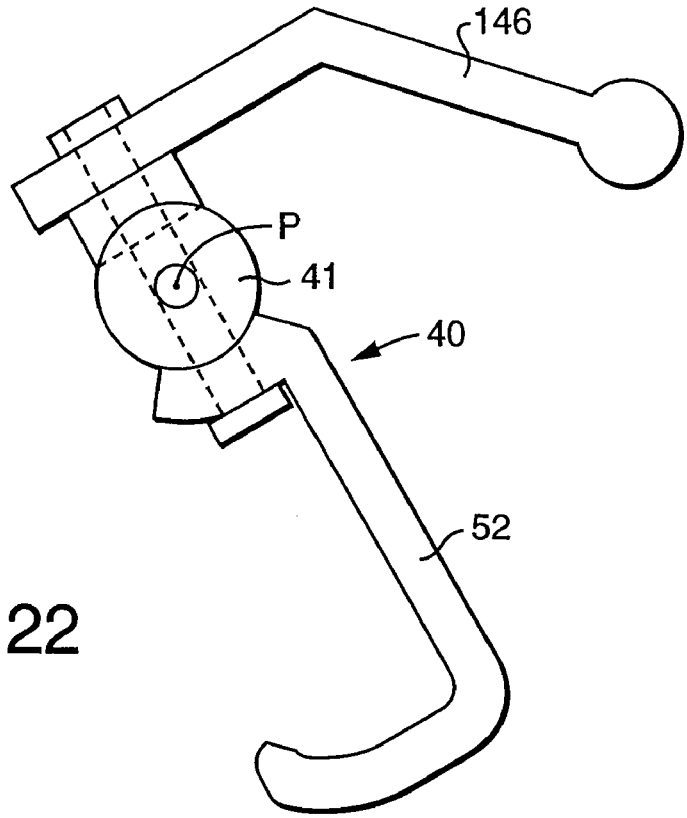
FIG. 22 represents a lid cam lock assembly in the unlocked position.
Figure 23:
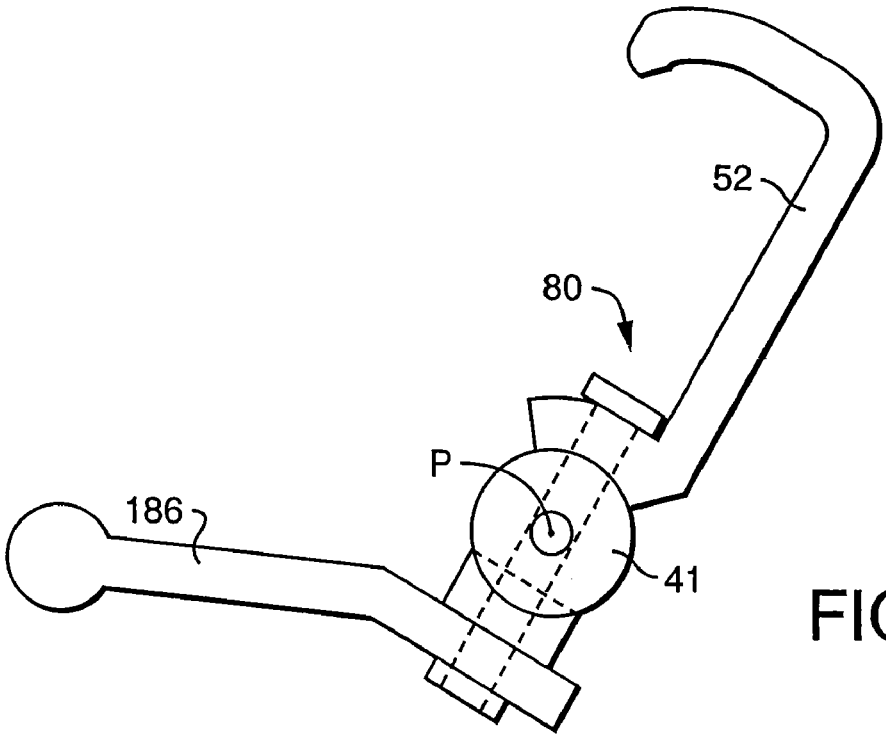
FIG. 23 represents a pallet cam lock assembly in the unlocked position.

FIGS. 9-11 show the lid handle 46. As shown, handle 46 is of unitary construction. Lid handle 46 includes a cam engaging portion 47 which is preferably 2 inches wide, 1.75 inches long, and 0.25 inch thick. A pair of spacers 28 are spaced apart 1.25 inches from their centers. The center of each spacer 28 is 0.5 inch from the end of the cam engaging portion 46 away from the angled handle portion 50. Spacers 28 are about 0.25 inch thick and have a diameter of 0.625 inch. A bore 49 of about 0.25 inch diameter passes through the center of each spacer 28 and adjacent cam engaging portion 47. Extending from cam engaging portion 47, and at an angle of 135° thereto, is angled handle portion 50 having head 51 at its end. Angled handle portion 50 is 2 inches long, 2 inches wide and 0.25 inch thick. Head 51 is cylindrical with a diameter of 0.5 inch. Lid handle 146, shown in FIGS. 20 and 22, is identical to lid handle 46 in size and geometry, except spacers 148 are not unitary with cam engaging portion 147.

Figure 13:
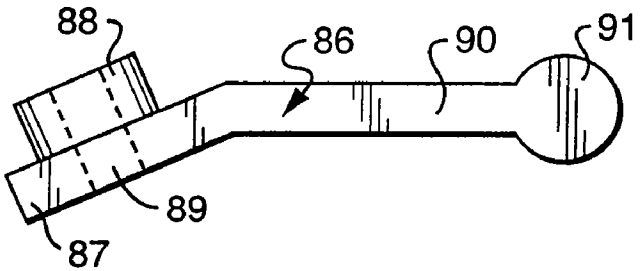
FIG. 13 is a side view of the pallet handle of FIG. 12.
Figure 14:
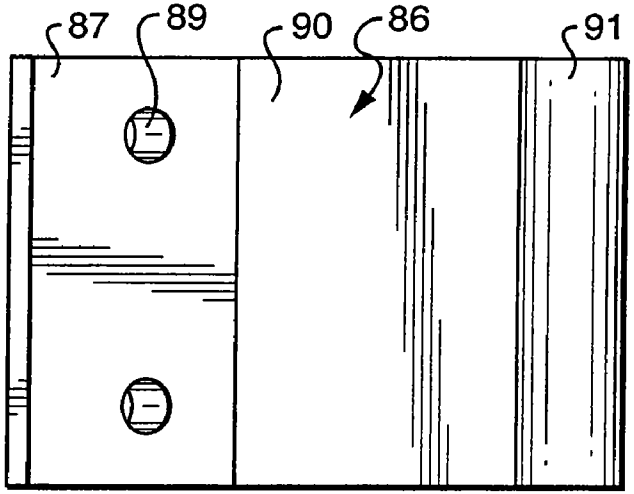
FIG. 14 is a bottom view of the pallet handle of FIG. 12.
Figure 12:
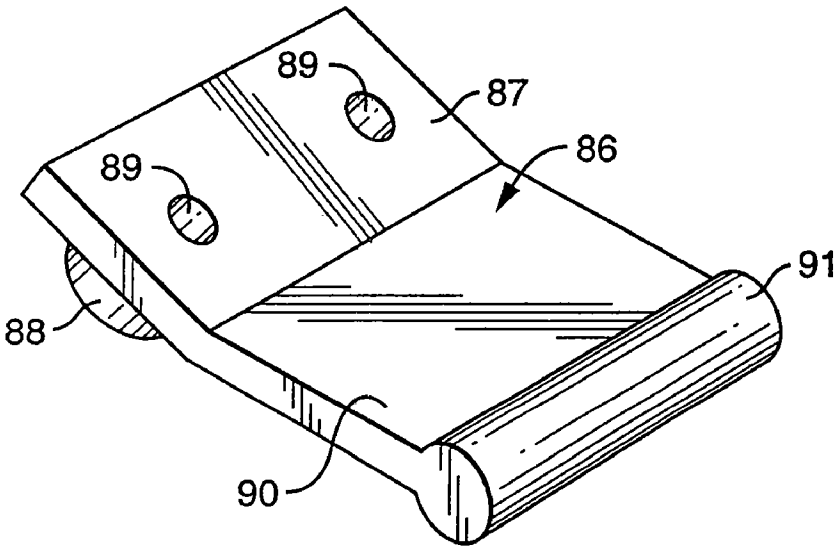
FIG. 12 is a perspective view of a pallet handle.

FIGS. 12-14 show the pallet handle 86. As shown, handle 86 is of unitary construction. Pallet handle 86 includes a cam engaging portion 87 which is preferably 2 inches wide, 1.153 inches long, and 0.25 inch thick. A pair of spacers 88 are spaced apart 1.25 inches from their centers. The center of each spacer 88 is 0.583 inch from the end of the cam engaging portion 86 away from the angled handle portion 90. Spacers 88 are about 0.25 inch thick and have a diameter of 0.625 inch. A bore 89 of about 0.25 inch diameter passes through the center of each spacer 88 and adjacent cam engaging portion 87. Extending from cam engaging portion 87, and at an angle of 159° 27' thereto, is angled handle portion 90 having head 91 at its end. Angled handle portion 90 is 1.75 inches long, 2 inches wide and 0.25 inch thick. Head 91 is cylindrical with a diameter of 0.5 inch. Pallet handle 186, shown in FIGS. 20 and 22, is identical to pallet handle 86 in size and geometry, except spacers 188 are not unitary with cam engaging portion 187.

Figure 17:
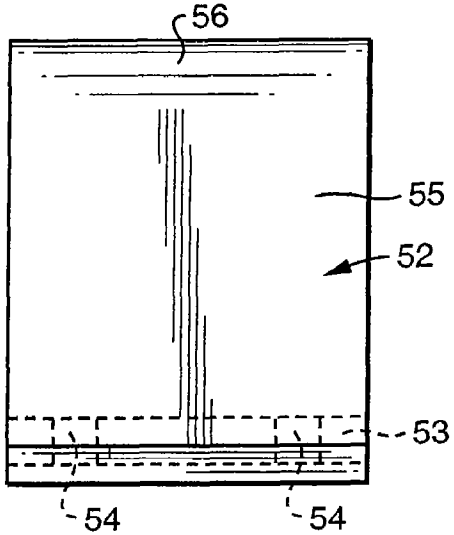
FIG. 17 is a back view of the lock of FIG. 15.
Figure 16:
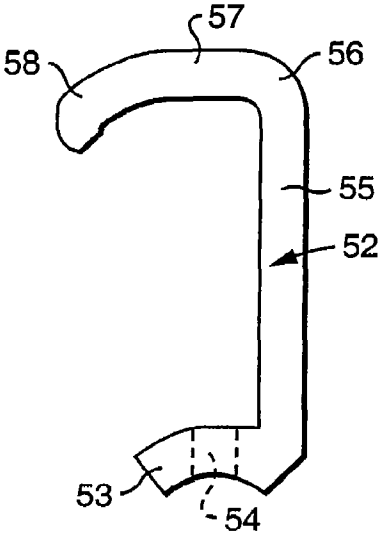
FIG. 16 is a side view of the lock of FIG. 15.
Figure 15:
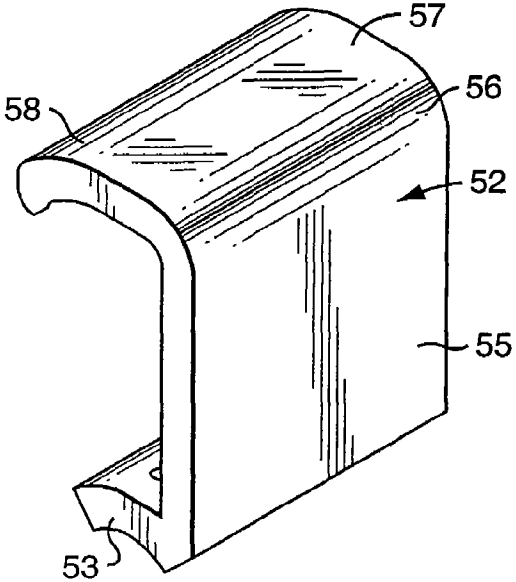
FIG. 15 is a perspective view of a lock.

FIGS. 15-17 show lock 52. Lock 52 includes an arched cam engaging portion 53 having a radius of curvature of 0.438 inch so that it matches with the cam 41/141 diameter of 0.875 inch. Lock 52 has a width of 2 inches and a thickness generally of 0.25 inch. Portion 53 includes a pair of bores 54 of diameter 0.25 inch, spaced 1.25 inches apart at their centers. Extending 1.75 inches from portion 53 is connection portion 55. At the other end of connection portion 55 from portion 53 is hook portion 56. Hook portion 56 includes straight portion 57 and curved end portion 58.

It is envisioned that handles 46/146/86/186 and lock 52 are manufactured by injection molding. For handles 146/186 where spacer 148/188 is a separate part from the respective handle, the spacer 148/188 can be of stainless steel, or other suitable material. Bolt 59 and lock nut 62 can also be of stainless steel, or other suitable material. Alternatively, instead of an injection mold, a profile type mold can be used to make handles 46/146/86/186 and lock 52.

The preferred measurements provided above are such that the various components of lid and pallet cam lock assemblies 40/80 can be joined by a bolt 59, having a head 60 and threaded portion 61, which receives a lock nut 62. A lid cam lock assembly 40, for example as shown in FIG. 20, is formed by passing a bolt 59 first through the bores 54 in lock 52, then through the bores 45 in cam 41/141, then through bores 49 in spacer 48/148 and cam engaging portion 47/147 in lid handle 46/146, and then placing lock nut 62 on threaded portion 61 of bolt 59.

Figure 21:
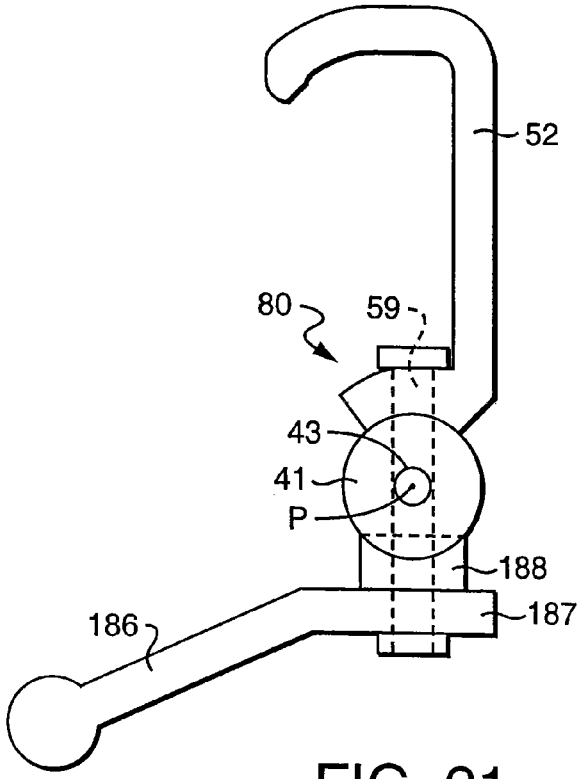
FIG. 21 represents a pallet cam lock assembly in the locked position.

Likewise, a pallet cam lock assembly 80, for example as shown in FIG. 21, is formed by passing a bolt 59 first through the bores 54 in lock 52, then through the bores 45 in cam 41/141, then through bores 89 in spacer 88/188 and cam engaging portion 87/187 in pallet handle 86/186, and then placing lock nut 62 on threaded portion 61 of bolt 59. By using the bolt 59/nut 62 configuration with separate lock 52, cam 41/141, and lid 46/146 or pallet handles 86/186, the lid 20 and pallet 70 can be properly molded, as explained hereinafter, and any lock 52 or handles 46/146/86/186 which might break can be easily replaced.

Clearly those skilled in the art can modify the dimensions given for those components shown in FIGS. 9-19 and described herein, as those dimensions may be adjusted for different sized pallet assemblies 10, as desired.

With particular reference to FIG. 1, the preferred configuration of lid 20 and pallet 70 are shown. As was previously mentioned, lid 20 and pallet 70 are molded of HDPE. For strength, lid 20 includes a molded top portion 20 having ribs 23 and cavities 24. Four stacking posts 25 extend upward from the molded top portion 22. Looking at the skid portions 78 of pallet 70, one can see that the skid portions 78 of a second pallet assembly 10 would fit onto the pallet assembly 10 shown in FIG. 1 such that the stacking posts 25 would be received by the skid portions 78 such that the two pallet assemblies 10 would be securely stacked. As the stacking posts 25 are smaller at their topmost portion and larger at their lowermost portion (closest to ribs 23), a second pallet 70 being placed atop a first lid 20 will tend to self align. As many pallet assemblies 10 as desired, or as dictated by weight limitations, can be securely stacked by engaging the stacking posts 25 of one pallet assembly 10 with the skid portions 78 of the adjacent pallet assembly 10. This secure stacking can be employed with pallet assemblies 10 having things to be shipped employing sleeve 12 (for example, FIGS. 24/25) or with pallet assemblies 10 being returned for refilling and storing sleeve 12 between lid 20 and pallet 70 (for example, FIGS. 26/27).

Figure 3:
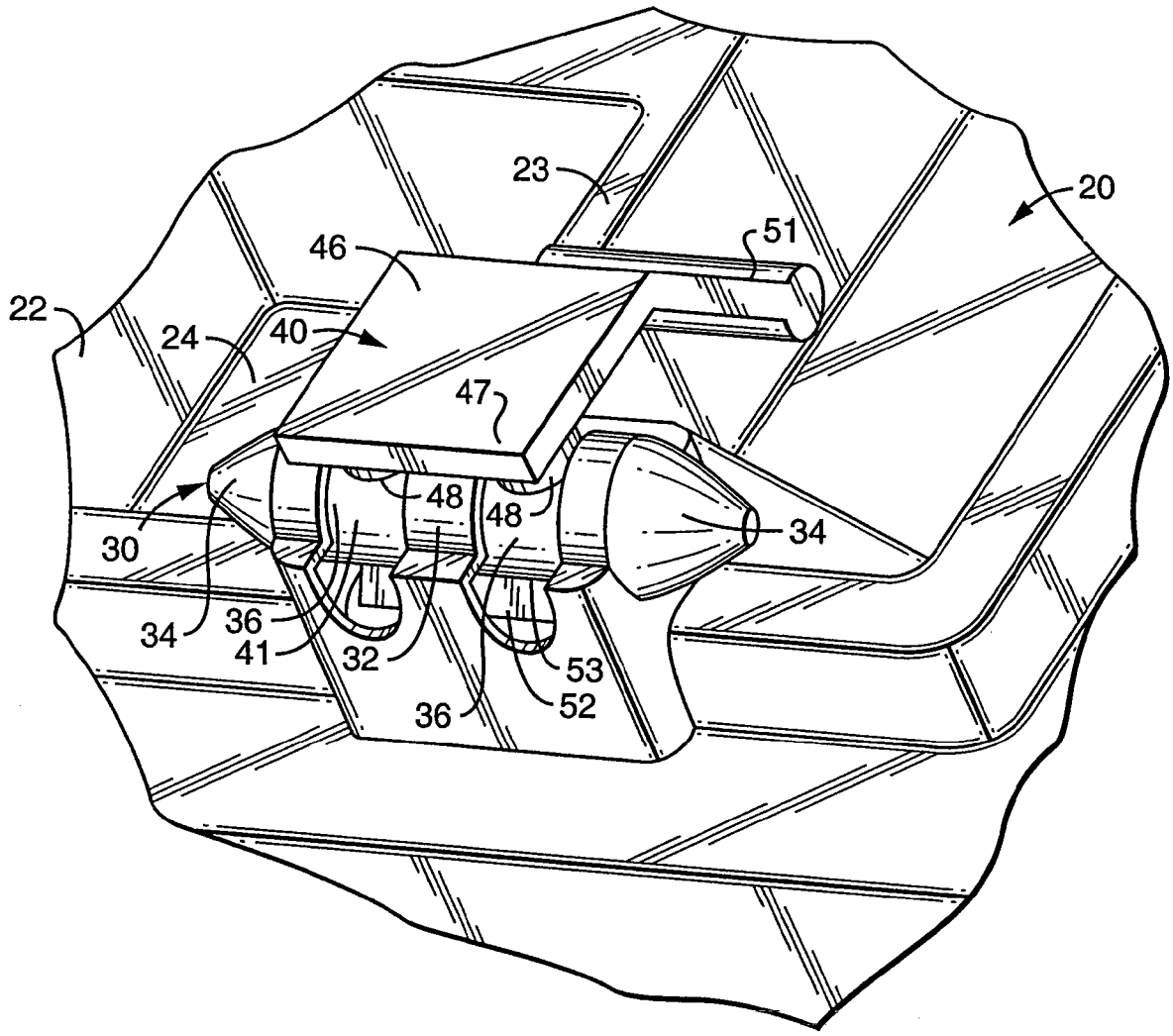
FIG. 3 is an enlarged view of a portion of a lid showing one of the cam lock assembly molded housings with a lid cam lock assembly therein, the cam lock assembly in the locked position.

As was mentioned, lid 20 has four lid cam lock assemblies 40, each in a cam lock assembly molded housing 30. FIG. 3 shows a close up view of a portion of lid 20 having one cam lock assembly molded housing 30 and its lid cam lock assembly 40. As shown, a cam 41 of FIG. 18 is employed. This cam 41 includes cylinder portion 42 and tapered ends 43. As was previously mentioned, cam 41 is of UHMW and lid 20 is of HDPE. Because these materials are dissimilar and will not form together during molding, the cam 41 is placed in the mold and the housing 30 molded thereround. Therefore, the similar shape. The taper shown in FIG. 18 and described herein, or other less or severe taper can be used. However, it is believed that a tapered cam, such as cam 41, is preferred over a non-tapered cam 141 because it is easier to free cam 41 from the pallet 70 or lid 20 after molding.

Housing 30 includes cylinder portion 32, tapered ends 34, and openings 36. With tapered ends 34 of housing 30 and tapered ends 43 of cam 41, any potential binding which would inhibit rotation of cam 41 in housing 30 is believed reduced. It was previously explained that, using bolt 59/nut 62 (not shown in FIG. 3), lock 52 and lid handle 46/146 are attached to cam 41 after the lid 20 is molded. As is shown in FIG. 3, spacers 48 space handle 46 (or spacers 148 if using handle 146) from housing 30 to permit movement of handle 46. Handle 46 is shown in the locked position, with spacers 48 toward one end of openings 36. Toward the other end of openings 36, part of arched cam engaging portion 53 of lock 52 is shown. Openings 36 permit the lid handle 46 to be pulled upward and away from lid 20 to an unlocked position. By molding the cam 41/141 in the housing 30, openings 36 can be minimized to only permit the minimum movement required of the handle 46 to move between the locked and unlocked positions. This assists in making the pallet assembly 10 virtually contamination free.

While not shown with the detail of FIG. 3, the cam lock assembly molded housings 79 in pallet 70 are similar to housing 30 and the molding process, placing the cams 41/141 in the pallet mold, is the same as with lid 20. Housings 79 include cylinder portions 32, tapered end portions 34, and openings 36, and the installation, function, and operation of pallet cam lock assemblies 80 is similar to that of lid cam lock assemblies 40.

With particular reference to FIGS. 1, 2, and 8, pallet 70 is shown having a base portion 71 and cavitied base portions 72 for strength. Inner wall portion 73 and outer wall portion 74 with top wall lip portion 75 therebetween was previously explained. Also, pallet cam lock receiving recess 76 and lid cam lock receiving receptacle 77 were previously explained. FIGS. 1 and 2 show the surfaces of outer wall portion 74 and inner wall portion 73 to be undulating surfaces. FIG. 8 shows the surface of inner wall portion 73 to be an undulating surface while outer wall portion 74 is not undulating. Either portion 73 or 74 or both portions 73 and 74 can have undulating or corrugated surfaces for strength, as desired.

FIG. 2 shows sleeve 12 placed inside pallet 70's outer wall portion 74 with its bottom touching base portion 71. Sleeve 12 includes two pair of short side walls 13, each pair having a fold seam 14 therebetween, and two pair of long side walls 15, each pair having a weld seam 16 therebetween. Routed fold areas 17 are between the short side walls 13 to the long side walls 15. As was previously explained, each long side wall 15 has a lid cam lock receiving opening 18 and a pallet cam lock receiving opening 19 therein. Many materials of construction are possible for sleeve 12. As shown in FIG. 2, sleeve 12 is of a corrugated polypropylene plastic having a thickness of about 13 mm. This sleeve 12 includes an outer skin 7 and an inner skin 8, each about 0.050 inch thick with vertical members or corrugations 9 therebetween. This sleeve 12 is manufactured in two pieces and then the two pieces are attached at weld seams 16. To create fold seam 14, a ⅛ inch wide vertical cut is routed down the sleeve 12 which leaves only outer skin 7 at fold seam 14. Likewise, to create routed fold area 16, a 1¼ inch wide vertical cut is routed down the sleeve 12 which leave only outer skin 7 at routed fold area 16. The 1¼ inch wide cut permits the sleeve 12 to fold without stretching. With the geometry of lock 52 of the preferred embodiment explained herein, sleeve 12 can range in thickness from about 6 mm to about 19 mm. As examples, pasteboard, solid plastic, wood, and other materials or combinations of materials can also be used to construct sleeve 12.

FIGS. 20-23, while separate figures, are positioned on the sheet to demonstrate the locked positions of assemblies 40/80 (FIGS. 20/21) and the unlocked positions of assemblies 40/80 (FIGS. 22/23). P identifies the "pivot point" or the long axis of cam 41. When the various handles 46/146/86/186 are moved from locked to unlocked positions, spacers 48/148/88/188 can move in openings 36 and cam 41 pivots or rotates about its long axis P. In looking to FIGS. 20 and 22, as well as FIGS. 1, 3, and 24-27, one sees how lock 52 moves when moving handle 146 from the locked (FIG. 20) to unlocked (FIG. 22) position. Similarly, in looking to FIGS. 21 and 23, as well as FIGS. 1-2, 4-7, and 24-27, one sees how lock 52 moves when moving handle 186 from the locked (FIG. 21) to unlocked (FIG. 23) position.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A pallet assembly, comprising:

(a.) a lid having a top portion and sides therearound, said sides therearound having an inverted channel therein, said inverted channel having a channel lip, said lid having a lid outside and a lid inside;

(b.) a pallet having a pallet outside and a pallet inside, said pallet having a pallet base portion and a wall portion extending upward therefrom, said wall portion having an outer wall portion and an inner wall portion, said wall portion terminating in a pallet lip portion;

(c.) where, said lid is configured to be placed onto said pallet and supported in position thereon by an engagement of said channel lip and said pallet lip portion;

(d.) said lid having at least one lid cam lock assembly housed by a cam lock assembly housing; said at least one lid cam lock assembly having a cylindrical cam within said cam lock assembly housing, a handle accessible from said lid outside, a spacer interconnecting said handle and said cylindrical cam, and a lock, said lock having a cam engaging portion, a hook portion, and a connecting portion interconnecting said cam engaging portion and said hook portion, said cam engaging portion engaging said cam, said lock located on said lid inside;

(e.) said inner wall portion of said pallet having at least one lid cam lock receiving receptacle therein; and (f.) where, said lid can be placed onto said pallet and supported thereon by an engagement of said channel lip and said pallet lip portion and said handle of said at least one lid cam lock assembly can be moved from an open position to a closed position, thereby having said hook portion of said lock of said at least one cam lock assembly engage said at least one lid cam lock receiving receptacle.

2. The pallet assembly of claim 1, further comprising:

(a.) a sleeve; said sleeve having at least one lid cam lock receiving opening therein and at least one pallet cam lock receiving opening therein;

(b.) said pallet having at least one pallet cam lock assembly housed by a cam lock assembly housing; said at least one pallet cam lock assembly having a cylindrical cam within said cam lock assembly housing, a handle accessible from said pallet outside, a spacer interconnecting said handle and said cylindrical cam, and a lock, said lock having a cam engaging portion, a hook portion, and a connecting portion interconnecting said cam engaging portion and said hook portion, said cam engaging portion engaging said cam, said lock located on said pallet inside;

(c.) where, said sleeve can be placed into said pallet and extend upward therefrom, thereby engaging said pallet base portion and being adjacent said inner wall portion, said handle of said at least one pallet cam lock assembly can be moved from an open position to a closed position, thereby having said hook portion of said lock of said at least one pallet cam lock assembly engage said at least one pallet cam lock receiving opening in said sleeve;

(d.) where said lid can be placed onto said sleeve and supported thereon, said handle of said at least one lid cam lock assembly can be moved from an open position to a closed position, thereby having said hook portion of said lock of said at least one lid cam lock assembly engage said at least one lid cam lock receiving opening in said sleeve.

* * * * *